US005953757A

United States Patent [19]

Blanks, I

[11] Patent Number: 5,953,757

[45] Date of Patent: Sep. 21, 1999

[54] INTERCHANGING AND/OR REVERSING VARIOUS SECTIONS OF ARTICLES MADE OF FABRIC MATERIALS WHICH CAUSES PARTIAL ALTERATION THEREOF

[76] Inventor: Stevenson T. Blanks, I, c/o Rita Coleman 1422 Pearce Park, Apt. 6, Erie, Pa. 16502

[21] Appl. No.: 08/889,658

[22] Filed: Jul. 8, 1997

Related U.S. Application Data

[60] Provisional application No. 60/021,343, Jul. 8, 1996.

[51] Int. Cl.[6] ..... A41D 27/00; A41D 27/20

[52] U.S. Cl. ..... 2/243.1; 2/246; 2/247; 2/69; 2/115; 2/108; 2/209.13; 2/912

[58] Field of Search ..... 2/115, 227, 912, 2/913, 914, 917, 918, 919, 69, 243.1, 246, 108, 209.13, 247–251, 920, 244, 195.1; 40/124.06, 360, 661.04, 586, 725, 732, 760

[56] References Cited

U.S. PATENT DOCUMENTS

| | | | |
|---|---|---|---|
| 1,467,680 | 9/1923 | Oda | 2/247 |
| 2,589,409 | 3/1952 | Leichter . | |
| 2,986,743 | 6/1961 | Eilen | 2/247 |
| 3,537,108 | 11/1970 | Daniels | 2/247 |
| 3,828,368 | 8/1974 | Lam | 2/227 |
| 3,889,297 | 6/1975 | Jarboe et al. | 2/270 |
| 4,266,300 | 5/1981 | Partridge | 2/247 |
| 4,710,981 | 12/1987 | Sanchez | 2/115 |
| 4,776,043 | 10/1988 | Coleman | 2/199 |
| 4,803,740 | 2/1989 | Dawson | 2/919 |
| 4,899,395 | 2/1990 | Spector | 2/247 |
| 4,924,613 | 5/1990 | Levin | 2/247 |
| 5,063,614 | 11/1991 | McSheffery | 2/247 |
| 5,159,718 | 11/1992 | Moyer | 2/79 |
| 5,689,829 | 11/1997 | Rose | 2/94 |
| 5,794,267 | 8/1998 | Wallace | 2/69 |

*Primary Examiner*—Amy Vanatta
*Attorney, Agent, or Firm*—Jones, Tullar & Cooper, P.C.; Daniel A. Sullivan, Jr.

[57] ABSTRACT

An article of a fabric material having an outside surface, an inside surface, and an orifice, and an affixing means on the inside surface bordering the orifice and hidden from view when one views the orifice and the outside surface. Provided in conjunction therewith is an underlying section having an imprint, pocket or pouch on one side thereof, and an affixing means on a border region of said one side, outwards of the imprint, pocket or pouch. The underlying section can be affixed to the affixing means to be visible in the orifice when one views the orifice and the outside surface. The underlying section can further have an imprint, pocket or pouch on a second side thereof, and affixing means also on a border region of this second side, outwards of the imprint, pocket or pouch on the second side. This allows either side of the underlying section to be displayable in the orifice.

20 Claims, 12 Drawing Sheets

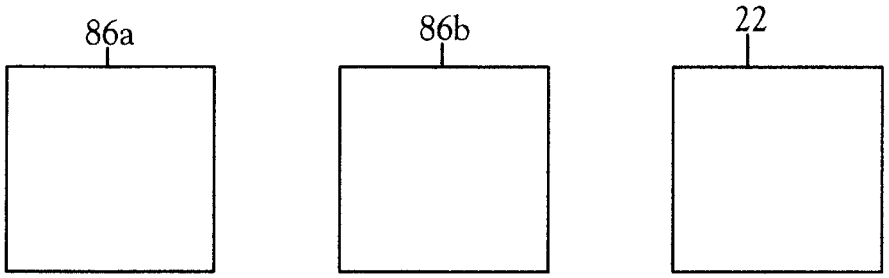
Fig. 3A
Fig. 3B
Fig. 3C
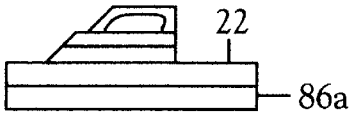
Fig. 3D
Fig. 3E
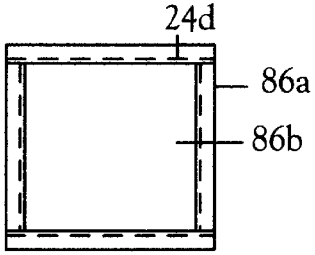
Fig. 3F
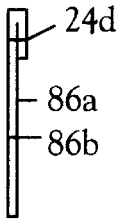
Fig. 3G
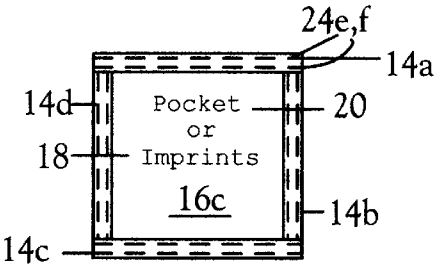
Fig. 3H
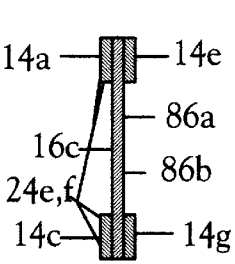
Fig. 3J
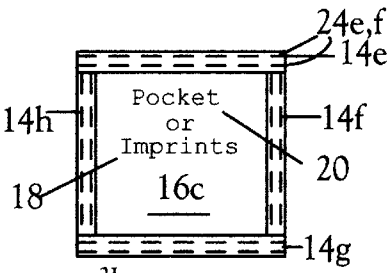
Fig. 3I

30

30

36

28

34

34a

26

32

60a-c 60a-c 60a-c 12a
60a-c 60a-c
24o,p
12a-c 62a-c
24r
24q
12a-c
10d

10d 94
60a
18
60b
60c
24s

INTERCHANGING AND/OR REVERSING VARIOUS SECTIONS OF ARTICLES MADE OF FABRIC MATERIALS WHICH CAUSES PARTIAL ALTERATION THEREOF

CROSS-REFERENCE TO RELATED APPLICATION

The benefit of provisional application No. 60/021,343 filed Jul. 08, 1996 is claimed. Provisional application No. 60/021,343 filed Jul. 08, 1996 is incorporated herein by reference.

BACKGROUND OF THE INVENTION

1. Field of the Invention

This present invention has relevance to articles made of fabric materials, and to their manufacturing.

2. Description of Related Art

The related art section will be described in two segments.

1) The first segment is about apparel which are manufactured to be worn with customized permanent imprints or imprinted patches that are painted or sewn directly on. Afterwards, I will touch upon the limitations of the construction.

2) The second segment is about apparel which are manufactured to be worn with removable and exchangeable panels or patches and pockets or pouches having various logos, insignias, names, visual illustrations and colors. Afterwards, I will discuss the existing flaws and limitations that are in these constructions.

First Segment

Previously, as well as now, there are numerous articles of apparel such as coats, jackets, jerseys, sport shirts, sneakers and hats and the like, which were manufactured to be worn with customized imprints or imprinted patches having logos, insignias, messages, or visual illustrations of various sorts that are designed and made according to one's preference. These desired designs and imprints, or imprinted patches can be permanently placed on any of the above articles of apparel on desired exterior sections by imprinting or sewing them directly on any suitable, selected section.

These previous art designs were and are limited in benefiting the manufacturer and consumer. To name one of their limitations, suppose you purchase a coat, jacket, jersey, sport shirt or cap, that was custom-made to display the team logo of a particular team, which happens to be one of your favorites. Once you have purchased one of the above articles, that is all you get. You are limited to that particular article. Let's say you have five other favorite teams, which are in different leagues. If you desire to purchase one of the above articles to display the custom-made logos of your five favorite teams, this will result in you having to purchase five of above articles. Purchasing five extra articles may be prohibitively costly for you because of a lack of financial resourses.

Yet another limitation is not being able to properly show your loyalty to all of your favorite causes or events because of inability or unwillingness to buy the requisite multiplicity of articles of clothing. It is well known that all true followers of favorite and noteworthy causes or events would like to display their loyalty to these causes or events via an article that is imprinted to depict these causes and events.

These limitations have caused others to discover and invent alternative methods whereby these limitations can be somewhat overcome, which will hereafter be briefly explained and described in the second segment.

Second Segment

In the past, many inventors have demonstrated alternative methods for manufacturing shirts, coats, jackets, caps, and the like, that allow their wearers to display a variety of removable and exchangeable panels or patches that would bear logos, insignias, names, messages, or visual illustrations. These new methods, as depicted in prior art, demonstrate a seeming solution in putting an end to the described limitations mentioned above.

U.S. Pat. No. 2,527,258 (KAHN), U.S. Pat. No. 2,647,261 (RASSNER), U.S. Pat. No. 2,685,690 (CHRISMAN), U.S. Pat. No. 3,484,974 (CULMONE), U.S. Pat. No. 4,277,848 (BOEHLAND), U.S. Pat. No. 4,611,355 (GALANTO), U.S. Pat. No. 4,710,981 (SANCHEZ), U.S. Pat. No. 4,477,043 (COLEMAN), U.S. Pat. No. 4,924,613 (LEVIN), U.S. Pat. No. 5,052,056 (BRAUN), U.S. Pat. No. 5,086,516 (BAXTER), U.S. Pat. No. 5,136,726 (KELLIN), U.S. Pat. No. 5,168,580 (FOO) and U.S. Pat. No. 5,359,734 (RATHBURN) are illustrations of such. These U.S. Patents show various articles of apparel which are manufactured to bear a waist band. The replaceable panel fits within an aperture in the garment body and is co-planar with the garment body. The panel is fastened by a zipper extending continuously from the lower marginal edge portions of the panel and at the one side thereof, upwardly and across the shoulder, then downwardly to terminate at the lower marginal edge portion at the opposite side of the panel. The zipper is concealed beneath marginal overfolds of the panel and jacket body. The panel of Kahn has to have a certain degree of bigness, in order to work.

Next, U.S. Pat. No. 5,136,726 (KELLIN), shows articles of apparel having one or more detachable decorative elements replaceably coupled thereto, the article having substantially all exposed cloth surfaces made of stretchable material having a multiplicity of loop elements, the detachable decorative elements engaging the hook elements of the loop elements of the material.

Finally U.S. Pat. No. 4,710,981 (SANCHEZ) teaches a flap hingedly applied along one edge to a garment and held to the garment on the other edges by hooks-and-loops fastening means. the underside of the opaque flap has insignia fixed thereon for exhibiting when the flap is opened. The section of the garment covered by the flap may also have insignia affixed thereto.

However, none of these prior inventions is without its flaws.

The patented systems mentioned earlier, with the exception of U.S. Pat. No. 2,527,258, have either fabric or clear plastic sheet overlays, patches or panels which are secured to the outer portion of the desired clothing by the means of Velcro® or snaps. As a result of this the fastening means which temporarily fastens the overlays or patches can obviously be seen by an on-looking viewer simply by looking at the fabric or clear plastic sheet overlays, patches or panels from a side or top view. These teachings do not give the fabric or clear plastic sheet overlays, patches or panels the appearance of a PERMANENTLY-AFFIXED-LOOK TO IT'S DISPLAY which is very important to the article appearance. Any on-looking viewer can readily perceive that the fabric or clear plastic sheet are indeed overlays, patches or panels bearing insignia that are detachable, this making them susceptible to theft. It can easily come apart by pulling on the VELCRO® or snap fasteners.

Two other flaws that exist in the teachings of the above inventions are:

The fabric or clear plastic sheet overlays, patches or panels bearing insignia are secured to the outer portion of a coat, jacket, hat and the like by way of VELCRO® or snap fasteners. The VELCRO® or snap fasteners can come apart without the wearer's knowledge. This would cause (1) the coat, jacket or hat to look incomplete and tacky; (2) also the fabric or clear plastic sheet overlays, patches or panels could become lost without the wearer's knowledge of them being lost. Later, in the SUMMARY OF THE INVENTION, it will be made obvious to those having expertise in the art, how the present invention overcomes all of the flaws mentioned above.

Now, removable and exchangeable pockets or pouches in prior art will be the subject matter for discussion. Prior art demonstrates a host of articles of apparel having constructions enabling one to remove and exchange the pockets or pouches section of the articles which are designed and constructed for incorporating such.

For example U.S. Pat. No. 3,537,108 (DANIELS), illustrates a pocket construction which includes a rear panel and a rectangular front panel connected along it's base and one side edge to the rear panel. Hooks and loops of gripper type fasteners are connected to the front panel rear top and free side borders and to the rear panel in positions concurring with the front panel fasteners.

U.S. Pat. No. 3,840,901 (EYSTER), shows another pocket construction that is capable of being positioned and mounted on or at any desired location of a garment which can be of various sizes, shapes and designs. The pocket comprises at least a front panel having a top edge for forming the access opening between the panel and garment, adhesive means applied to at least portions of the periphery on the back side of the panel so that the pocket is capable of being affixed to the garment at any desired location thereon.

Lastly as far as pocket or pouch constructions are concerned, U.S. Pat. No. 5,054,127 (ZEVCHAK), proclaims a system of interchangeable pockets which comprises a plurality of foundation pads attached to articles of clothing and a plurality of interchangeable pockets. The pockets are made interchangeable by attaching a first type of fastening material to the back of each pocket and corresponding to the second type fastening material on each foundation pad.

There are a number of flaws existing in the pocket constructions of these inventions which are the following:

These pocket constructions are overlays, patches or panels that are removably placed onto the outer portion of a desired garment. (1) The fastening means can be seen by an on-looker from side, top or bottom views. (2) The pocket could also come apart without the wearer's knowledge which would cause the desired apparel to look second-rate. (3) These pocket constructions do not give off a PERMANENTLY-AFFIXED-LOOK TO THEIR DISPLAY, which is important to the article appearance. An on-looking viewer would obviously see that the overlay, patch or panel pocket construction is detachable, therefore capable of being stolen. (4) Lastly, because these are indeed overlays, there is a great chance of them being lost by becoming detached. My invention includes pocket constructions that overcome these flaws, as discussed below.

SUMMARY OF THE INVENTION

Hereafter, it will be self-evident that objects and advantages of the present invention include: the use of various designs and constructions whereby articles made of fabric materials, such as jackets, coats, pants, skirts, shorts, jerseys, jogging suits, books, duffle and tote bags, back packs, purses, sacks, gloves, caps or hats and the like, have sections that can be easily interchanged and/or reversed. Overall, this will partially alter the articles thereby creating novel effects in the articles.

For an example, if the article is a jacket, interchangeable and/or reversible underlying sections of the invention bearing imprints, including pockets or pouches also bearing imprints can be designed and constructed to fit in any desired suitable section of the jacket. The interchangeable and/or reversible underlying sections of the jacket may be more or less, depending on the manufacturer's preferences. There are no limits to the ways in which the invention can be applied.

These interchangeable and/or reversible underlying sections can: exhibit imprints, such as various colors, imprinted logos, insignias, names, messages, visual illustrations, pockets or pouches exhibiting the same imprints on them; and are outfitted with suitable affixing means namely snaps, buttons, zippers, and hooks and loops VELCRO® band-type fasteners. "Imprints" as used herein is meant to include means of imprinting something visual, including printing, designs woven into the fabric, embroidering, embossing, puff embroidery, thermo-fused embroidery and applique-fabric.

The present invention offers a great deal of assistance in eliminating the existing limitations and flaws that exist in related art teachings, as described above in the section DESCRIPTION OF RELATED ART. This has been achieved by designing and constructing the articles made of fabric materials and their interchangeable and/or reversible underlying sections in a careful, unique manner.

For an example, in all prior inventions, the patches or panels bearing imprints and the pocket or pouch are actually overlays to be placed on the exterior of the apparel. My patches or panels or, more generally, interchangeable and/or reversible underlying sections bearing imprints, and the pockets or pouches are designed and constructed to be, in fact, underlying sections, which are fitted within various geometrically shaped orifices, then underly on the back of creased borderlines of fabric, afterwards affixed onto the internal support structure, being fastened there by the utilization of suitable affixing means. The designs and constructions of the articles and the interchangeable and reversible underlying sections is described further below in the section DETAILED DESCRIPTION OF THE INVENTION. However, I will touch upon it here briefly.

Further objects and advantages of the present invention are realized by providing the articles and their interchangeable and/or reversible underlying sections, bearing various colors, imprints, pockets or pouches, with affixing means. Because of this, the articles can be partially altered, thereby bringing about novel effects. This will give the articles the capability of being many versions and/or the subtilty of one version. In other words, for example, if you like a particular football team, and if the article is a winter type sports jacket, it would be designed and constructed so that you could wear as many editions of that team's logos as you wish. Or let's say you also like a local hockey team, and a local baseball team, you can have the left and right sleeve sections of the jacket carry interchangeable and/or reversible underlying sections displaying the hockey team's logo, the back section of the jacket carry interchangeable and/or reversible underlying section displaying the baseball team's logo, all at once, or, if you wish, all coordinating the same team logo today, then interchanging or reversing all interchangeable and/or reversible underlying sections for a different edition of the same team logo tomorrow. Using team logos, for example, is just one of the many infinite features of this invention. Any known type affiliation, or preference, logo can be used to depict loyalty and also fashion. This feature can range from pictures of movies, to friends or family, or any artistic imprint. Because of the designs and constructions of the present invention, the above multitude of articles will always remain fresh and never out-dated, thus keeping pace with tomorrow's fashion trends and demands.

This feature would also cause a on-looking viewer to think that you have a variety of jackets bearing imprints, pockets or pouches on various sections of the jacket, when in reality you have only one jacket which has the capacity to be altered.

A few overall results will be:

1) Lessen the need for buying articles made of fabric materials every time old articles go out of style, thereby meeting and keeping up with the current fashion demands and styles.

2) Reducing the expense of articles made of fabric materials bearing customized patches.

3) Reduce the cost of manufacturing articles made of fabric materials.

4) Diminishing the need for retailers to carry limited articles made of fabric materials bearing customized imprints or imprinted patches. Often, retailers are not sure of which articles bearing imprints or imprinted patches the consumer likes and wants to purchase. Overall, the retailer can be overstocked with unsold articles which the consumer doesn't want, and because of this the prices on the articles will have to be reduced so that the retailer does lose too much money.

As was stated above, the present invention is designed and constructed in a unique manner. The articles made of fabric materials incorporate interchangeable and/or reversible underlying sections bearing either imprints, or pockets or pouches with imprints on them. The articles and their interchangeable and/or reversible underlying sections utilize various releasable fastening means to bring about the interchangeability, reversibility and alterability. This permits a user of the articles to implement the said underlying sections with the articles for a purpose or event and to interchange and/or reverse those sections from the articles and install another array of the said sections within them.

Another object is to provide a variety of interchangeable and/or reversible underlying sections of various sorts of metal materials of various geometrical shapes and sizes. These include interchangeable and/or underlying sections bearing imprints that are designed and constructed of non-flexible materials, such as gold, brass, silver, copper, lead, tin, aluminum, steel, bronze or wood, as well as of various flexible materials, such as rubber or plastic.

These materials can be fastened to a fabric that has been outfitted with affixing means. The fabric acts as a backing support for the materials bearing imprints.

Another important object of this present invention is to conceive designs and constructions in articles made of fabric materials, whereby the fastening means systems on the main body and on the interchangeable and/or reversible underlying sections would be completely masqueraded from view. This will provide the appearance that the articles are unitary articles, when in reality there are one or many interchangeable and reversible underlying sections incorporated into the articles.

These, along with other objects and various aimed advantages of this present invention, will become even more unmistakably clear when reference is made to the following descriptions coupled with and in association with the accompanying drawings, in which:

BRIEF DESCRIPTION OF THE DRAWINGS

FIGS. 3A–3J illustrate process, steps for preparing an interchangeable and/or reversible underlying section for installation into the article's (jacket) vented panel section of FIG. 1;

DETAILED DESCRIPTION OF THE INVENTION

Turning specifically now to the drawings, wherein like numerals denote like components, there is seen a back view of an article in the form of a jacket 90 made of fabric having a permanently affixed, vented, panel section 6 which enshrouds, upper sleeves and chest/back section. The vented panel section 6 as shown, has geometrically shaped (e.g. square) cut-out orifices 8*a*, 8*b* and 8*c*, at suitable locations. The vented panel section 6 also carries various internal support structures (to be described below) for admitting, affixing and enveloping geometrically shaped, interchangeable and/or reversible underlying sections 16*a–c*. Each of the underlying sections 16*a–c* contains either one or more imprints 18, or one or more pockets or pouches 20 which can likewise have imprints 18.

In order to clearly comprehend the designs and constructions of the enshrouding vented panel section 6, the various geometrically shaped, cut-out orifices 8*a*, 8*b* and 8*c*, and the internal support structure, FIGS. 2A–2I, should now be taken into consideration.

FIGS. 2A–2H, as depicted, illustrate one of the various ways the present invention can be designed and constructed (other designs and constructions will be mentioned later on). FIGS. 2A–2E are views onto the inside face of panel section 6.

Figure 1:
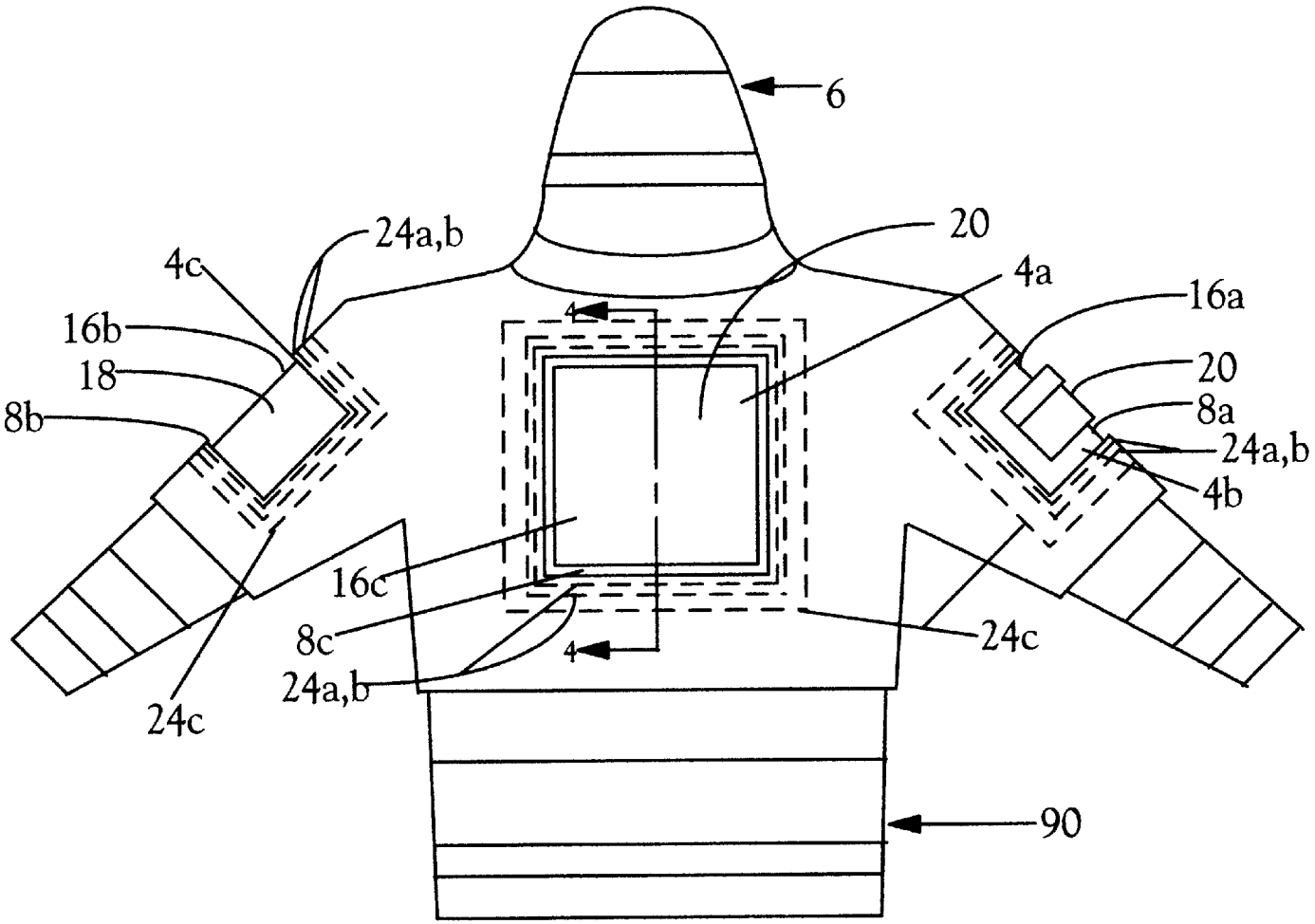
FIG. 1 shows, a back view of an article made of fabric materials (e.g. a jacket with a vented panel section)
Figure 2A:
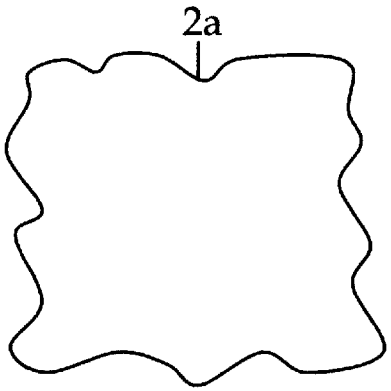
FIGS. 2A–2H are enlarged, fragmentary views, that illustrate process steps for making a vented panel section of FIG. 1.
Figure 2B:
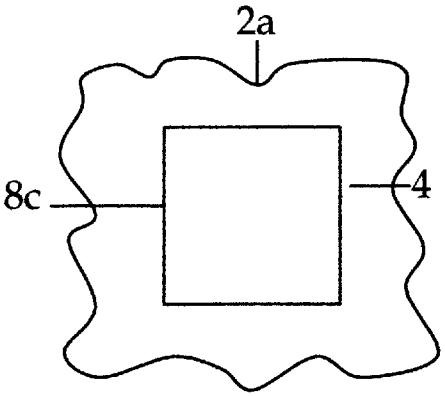
Figure 2C:
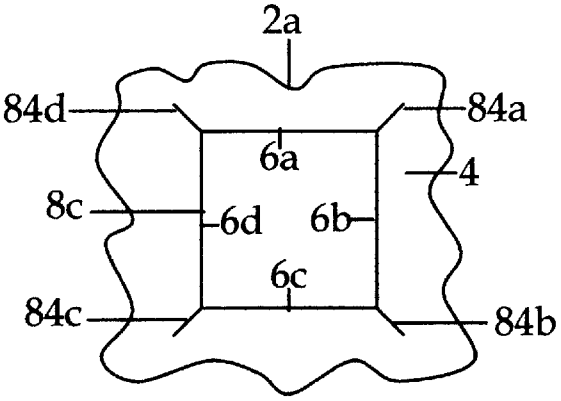
Figure 2D:
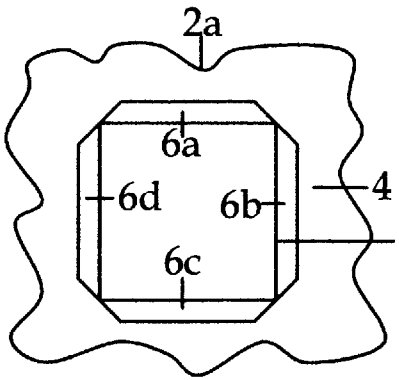
Figure 2E:
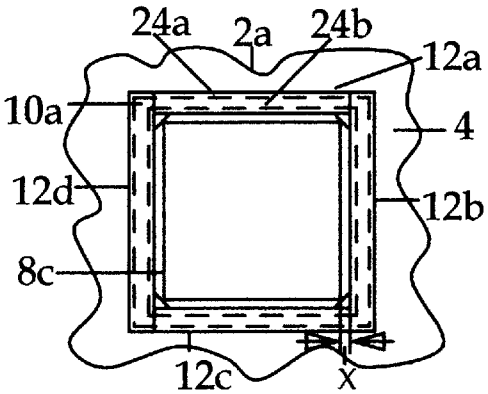

Geometrically shaped (e.g. square) orifice 8*c* of a desired measurement is cut in a desired fabric portion 2*a* (FIG. 2A) of panel section 6 to form a geometrically shaped fabric frame 4 as shown in FIG. 2B. Each corner of the orifice is cut on a 45 degree angle to form slits 84*a*–84*d* of desired length. This creates four flaps 6*a*–6*d* as shown in FIG. 2C. Next, each of the flaps 6*a*–6*d* are straightforwardly creased lengthwise, to become afterwards positioned as in FIG. 2D. Next, in FIG. 2E, the "hooks-part" segments 12*a*–12*d* of a two-part affixing fabric bands of hooks and loops, known as VELCRO®, cut to desired measurements (four lengths as shown), and coated with fabric glue, such as Weldbond®, on their back side, are each placed onto one of the flaps 6*a*–6*d*, spaced a desired distance X away from the geometrically shaped (e.g. square) orifice 8*c*. Additionally, as shown in FIG. 2E, the ban of hooks 12*a*–12*d* are afterwards stitched with stitching 24*a* and 24*b* along their edges. The VELCRO® bands 12*a*–12*d* (affixing means) as shown, when placed and permanently affixed onto the surface of the flaps 6*a*–6*d* away from the borderlines, forms an "internal support structure" 10*a* of a geometrical shape similar to that of the cut-out orifice 8*c*, as shown in FIG. 2E.

Figure 2F:
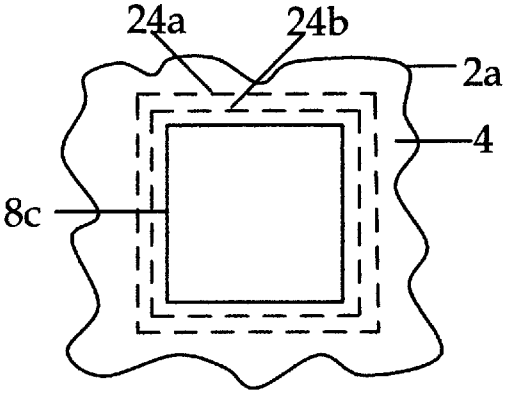
Figure 2H:
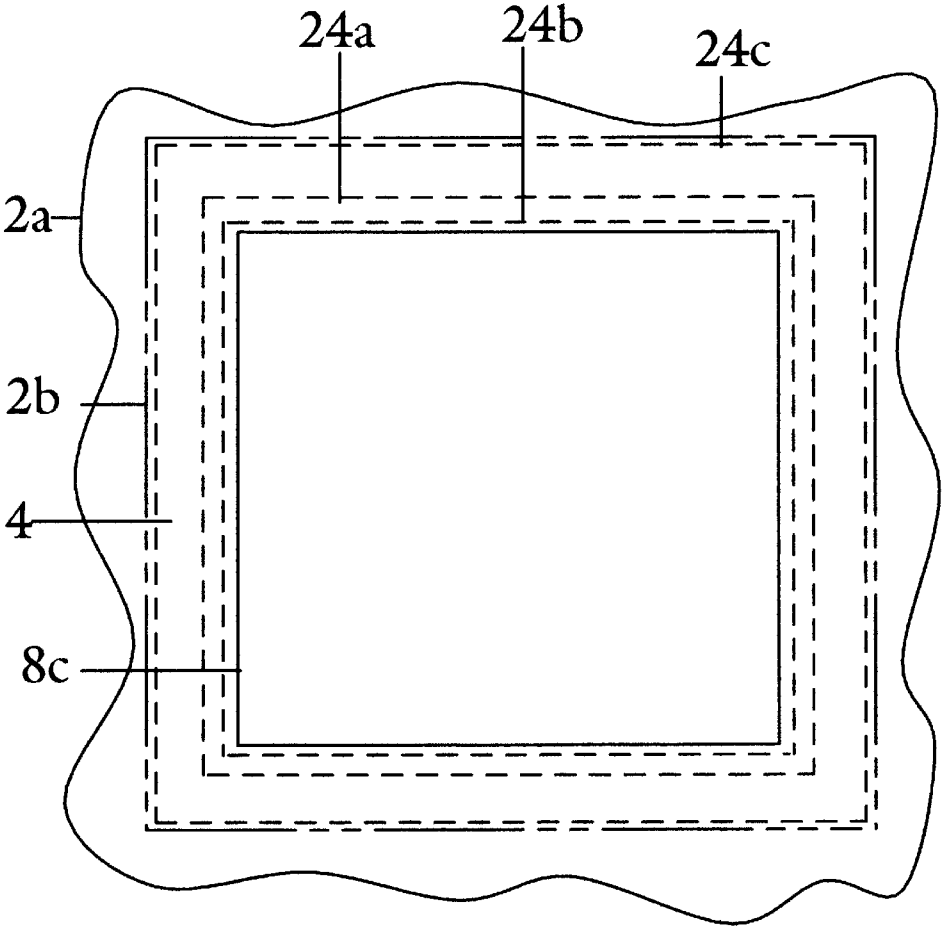
Figure 2G:
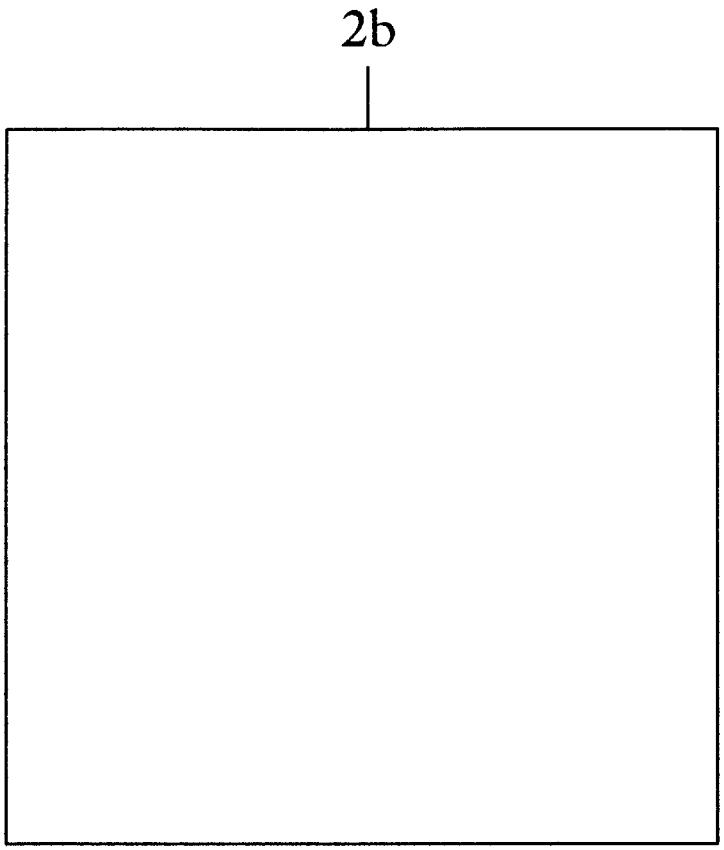

FIGS. 2F–2H show views onto the outside face of the vented panel section. As seen in FIG. 2F, the hooks 12*a*–12*d* part of two-part affixing bands are hidden from view after they are stitched with stitching 24*a* and 24*b* to the flaps 6*a*–6*d*.

It is preferable to sew the row of stitching 24*a* and 24*b* in a circumferential manner spaced ¾ to 1½ inches outside of the geometrically shaped (e.g. square), cut-out orifices.

FIG. 2G shows a second fabric panel 2*b* shaped similarly to, but larger than, the orifice 8*c*.

The material 2*a*, with the cut-out orifice 8*c* and the internal support structure 10*a*, has stitched to it, with a row of stitching 24*c*, the second fabric 2*b*, as shown in FIG. 2H, a view onto the face of panel section 6.

The stitching 24*c* joins fabrics 2*a* and 2*b* together. It also helps to aid and add strength to the internal support structure 10*a*. As seen in FIG. 2H, fabric panel 2*b* lies behind fabric 2*a*.

Orifices 8*a*–8*c* and structure 10*a* are for admitting, affixing and enveloping interchangeable and/or reversible, underlying sections 16*a–c* bearing either imprints 18, or pockets or pouches 20 which can likewise have imprints 18.

FIGS. 3A–3J shows steps for designing and constructing an interchangeable and/or reversible underlying section 16*a*–16*c*. A panel 86*a* (FIG. 3A) is cut from fabric into a geometrically shaped (e.g. square) desired size, for instance following the outer perimeters of the hooks part 12*a*–12*d* as affixed in FIG. 2E. Another panel 86*b* (FIG. 3B) is cut to the desired same shape and measurements as the first 86*a*. A piece of iron-on transfer adhesive sheet 22 (FIG. 3C) is then cut to that of the exact shape and measurements of the first 86*a* and second 86*b* fabric materials. A suitable example of sheet 22 is Wonder Bond® or Heat and Bond®. As shown in FIG. 3D, the iron-on transfer adhesive sheet 22 is then ironed to one side of the first fabric material 86*a*, which may, or may not, have an imprint 18, or pocket or pouch 20 on it at that time, depending on the manufacture's preference. The second fabric 86*b* is then ironed onto the back (FIG. 3E) of the first fabric material 86*a* which has the iron-on transfer adhesive sheet 22 on it. Next, as shown in FIG. 3F–3G, the raw borderline fabric materials 86*a* and 86*b* are creased ¼ of an inch in, then are sewn on all four sides with a row of stitching 24*c*. FIG. 3G shows just the creasing on the top side, by way of example; all sides are creased and sewn the same way.

The process of the previous paragraph is advantageous for fabrics that are not stiff. In other words, fabrics such as satin, velvet, nylon, some cotton, and the like require an additional, second fabric. This is preferable, because an additional fabric together-with another fabric that is not firm adds stiffness or firmness. Fabrics such as leather, canvas, heavy denim and the like are thick and somewhat firm; therefore, no additional fabric is required to add the stiffness that is preferred for the underlying sections 16*a*–16*d*.

As shown in FIGS. 3H and 3J, VELCRO® (two part affixing means) bands, this time in the form of four loops-part segments 14*a*–14*d* of desired measurement are supplied with glue on their backsides and afterwards placed and pressed along the border material on the frontside of the geometrically shaped (e.g. square), interchangeable and/or reversible underlying section 16*c*, which may, or may not, be carrying imprints 18 or a pocket or pouch 20 construction with imprints 18 on the pockets or pouches. Additionally, the VELCRO® segments 14*a*–14*d* (four of them) on the borderlines are then sewn in a circumferential manner with two lines of stitching 24*e* and 24*f*. When finished, a similar geometrical shape (e.g. square) has been fashioned to the appropriate size and geometrical shape (e.g. square) of each of the cut-out orifices 8*a*–8*c* and of the internal support structure 10*a* of the enshrouding, vented panel section 6.

Optimally, another four bands of loop material 14*e*–14*h* may be glued and sewed along the borders of the backside of underlying section 16*c*, as shown in FIG. 3I, and underlying section 16*c* may have an imprint, pocket or pouch on both sides. FIG. 3J shows a side view of underlying section 16*c*, with segments 14*a*–14*h* and stitching 24*e*–24*f*.

Affixing the geometrically shaped, interchangeable and/or reversible underlying section 16*c* onto the articles made of fabrics is very simple. All one has to do is insert the said underlying section 16*c* within the cut-out orifice 8*c* and between the fabrics 2*a* and 2*b* of the vented panel section 6 (i.e. the underlying section is inserted through the orifice), afterwards aligning the two part affixing means 12*a*–12*d* and 14*a*–14*d* of the internal support structure 10*a* and the said underlying section 16*c*, pressing them together making sure that there are no gaps or bad alignments. When finished, the geometrically shaped, interchangeable and/or reversible underlying section 16*c* should show the imprint 18, or a pocket or pouch 20 with imprint 18 facing through the geometrically shaped cut-out orifice 8*c* of the article. This resulting assembly is shown in the cross section of FIG. 4.

To remove the underlying section 16*c* from the article for the purpose of washing the article, or to reverse underlying section 16*c*, or interchange the underlying section 16*c* with a different underlying section 16*c*, simply pull completely apart the two part affixing means 12*a*–12*d* and 14*a*–14*d*, and afterwards remove the underlying section 16*c* from within the cut-out orifice 8*c*, then wash the article or interchange the underlying section 16*c* with a new one or reverse the underlying section 16*c*, afterwards affixing it back onto the article by following the above process.

Figure 4:
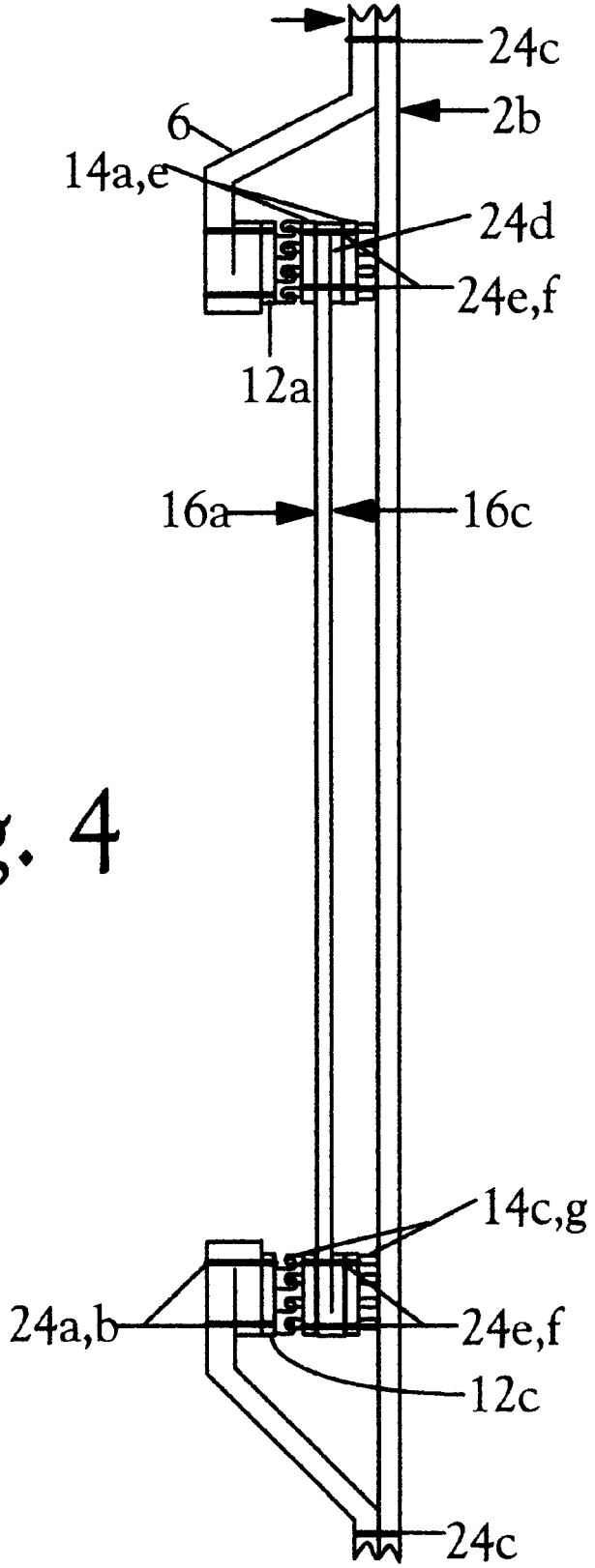
FIG. 4 is a cross-sectional view of FIG. 1, which shows an assembly of the invention taken on line through 4—4, on an enlarged scale.
Figures 5, 6, 7A, 7B, 8, 9A, 9B, 10:
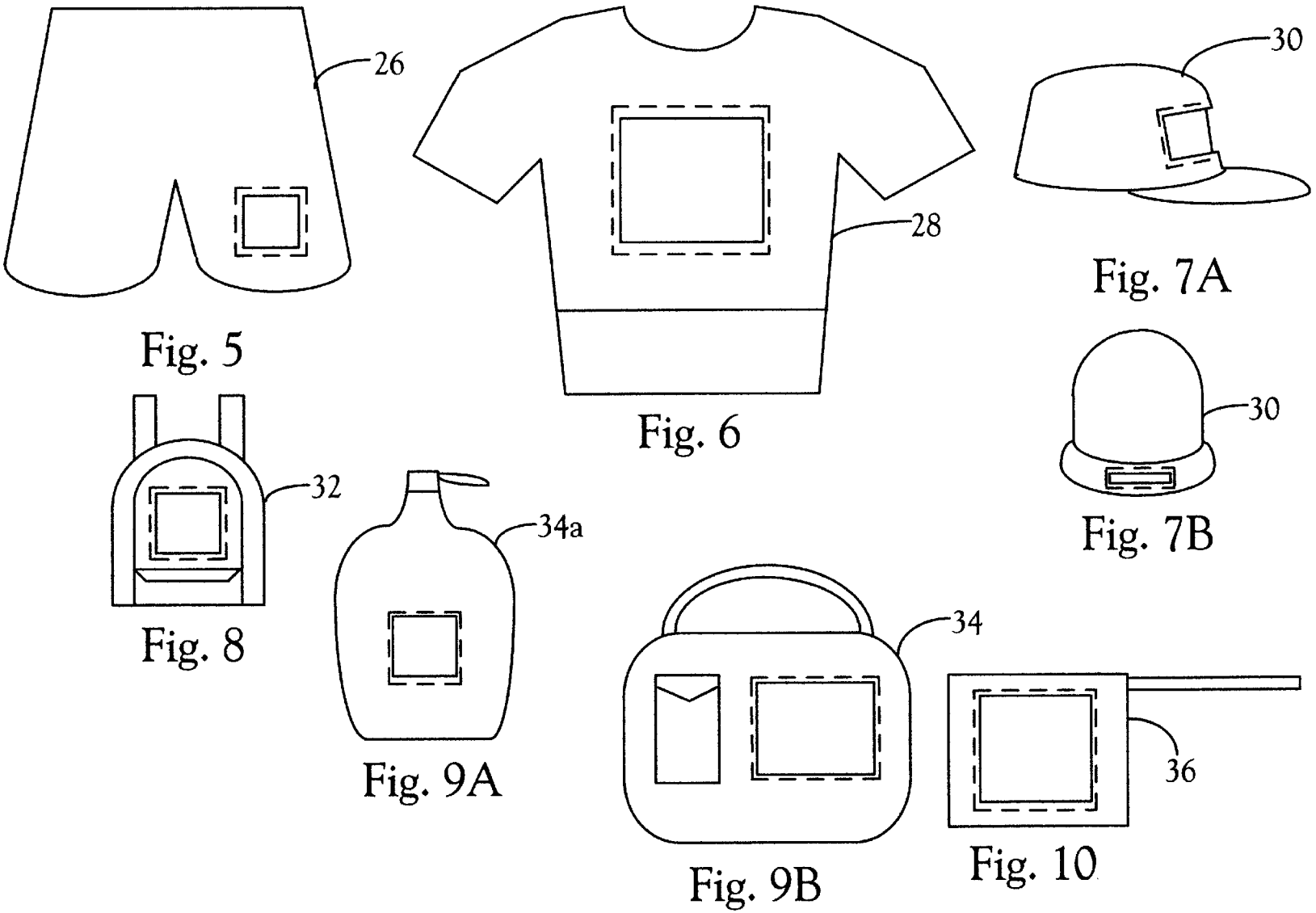
FIG. 5 shows a view of the invention in the embodiment of a pair of shorts.
FIG. 6 shows a view of the invention in the embodiment of a jersey.
FIGS. 7A–7B shows views of the invention in the embodiments of a cap and hat.
FIG. 8 shows a view of the invention in the embodiment of a back pack.
FIGS. 9A–9B shows views of the invention in the embodiment of two carrying bags.
FIG. 10 shows a view of the invention in the embodiment of a banner or flag.
Figure 12:
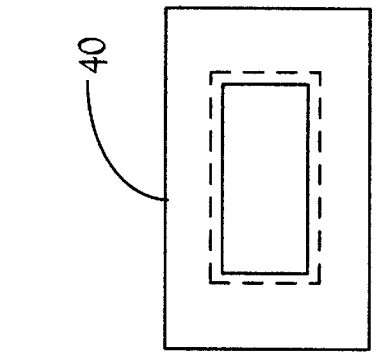
FIG. 12 shows a view of the invention in the embodiment of a pillow covering.
Figure 13:
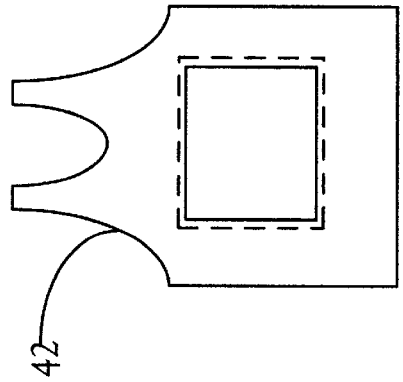
FIG. 13 shows a view of the invention in the embodiment of a tank top.
Figure 11:
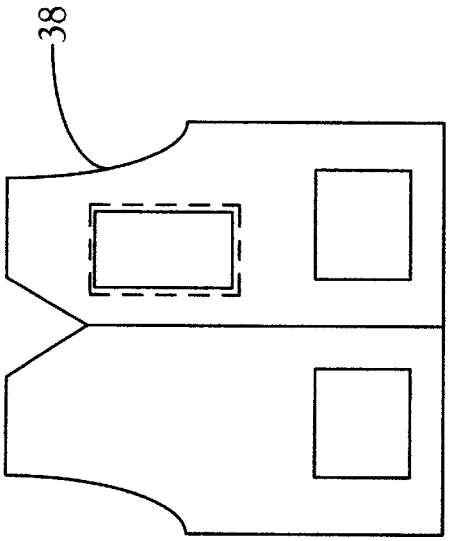
FIG. 11 shows a view of the invention in the embodiment of a vest.
Figure 14:
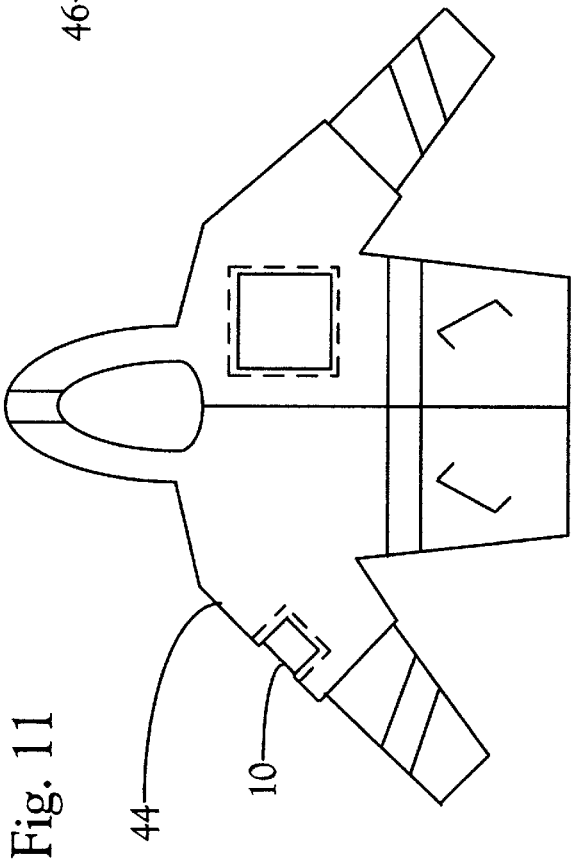
FIG. 14 shows a view of the invention in the embodiment of a jacket.
Figure 15:
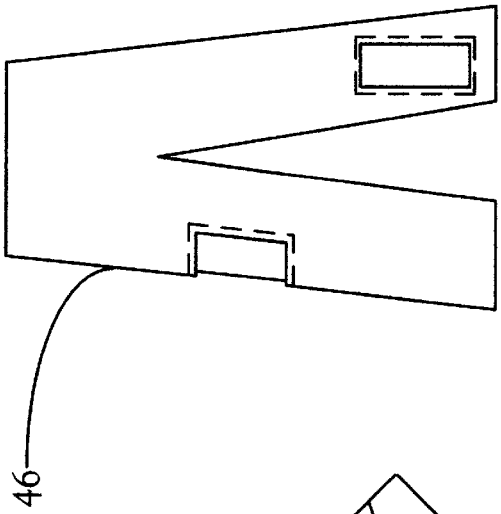
FIG. 15 shows a view of the invention in the embodiment of a pair of pants.

As seen in the cross-sectional view of FIG. 4, the fastening means 12*a*–12*d* and 14*a*–14*d*, respectively, on the vented panel section 6 and on the interchangeable and/or reversible underlying section 16*a*–16*c*, when fastened, is completely closed, and the said sections 16*a*–16*c* are, therefore, in no danger of being accidentally lost.

Although the invention has been illustrated in the form of a winter-type sports jacket with an enshrouded vented panel section 6, it is not to be limited to that particular article made of fabric materials. FIG. 5 thru FIG. 15 are illustrations of the present invention in various embodiments, namely, a pair of shorts 26 in FIG. 5, a jersey 28 in FIG. 6, a cap 30*a* and a hat 30*b* in FIGS. 7A–7B, a back pack or book bag 32 in FIG. 8, two carrying bags 34*a* and 34*b* in FIGS. 9A–9B, a banner or a flag 36 in FIG. 10, a vest 38 in FIG. 11, a pillow slip 40 in FIG. 12, a tank top 42 in FIG. 13, a jacket 44 in FIG. 14 and a pair of pants 46 in FIG. 15. Each of these FIGS. 5–15 shows that the article is an article of the invention, as indicated by the schematic symbol of a solidly outlined orifice surrounded by a dashed line of stitching. The field within the orifice may contain an underlying section imprinted or bearing a pocket or pouch.

Figure 16D:
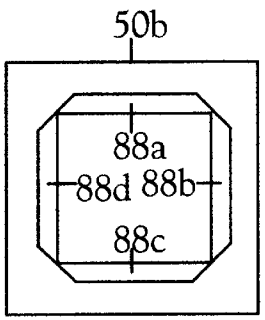
FIGS. 16A–16J show an alternative method of designing and constructing the present invention, more specifically the internal support structure.
Figure 16C:
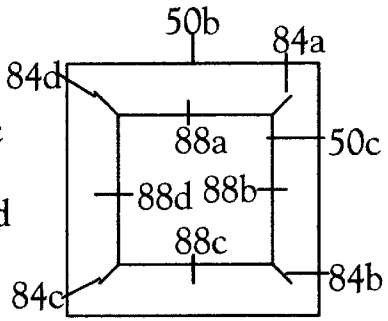
Figure 16B:
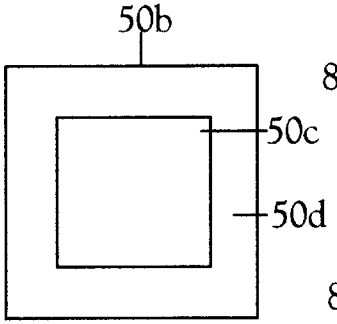
Figure 16A:
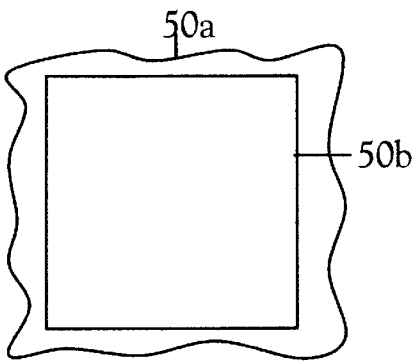
Figure 16H:
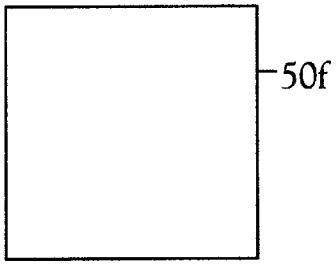
Figure 16G:
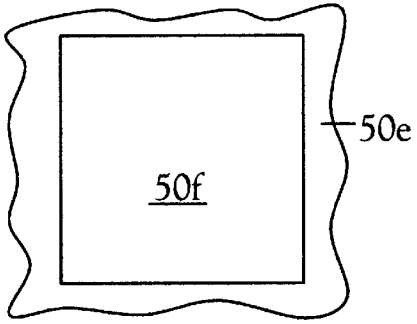
Figure 16F:
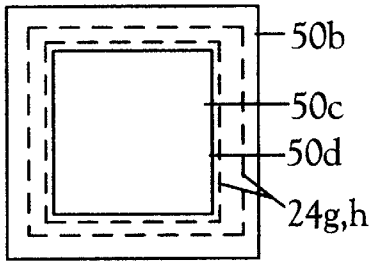
Figure 16E:
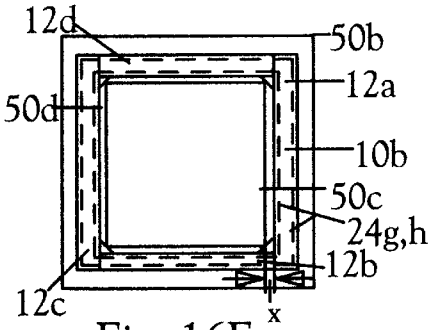

FIGS. 16A–16J illustrate an alternative method for designing and constructing the present invention, more specifically by providing an internal support structure 10*b*. A geometrically shaped (e.g. square) cut-out panel 50*b* of a desired measurement is circumferentially cut from a desired fabric 50*a*. Then a geometrically shaped (e.g. square) cut-out orifice 50*c* is made in the center of geometrically shaped (e.g. square) fabric 50*b* to form a fabric frame 50*d*. This is shown in FIGS. 16A and 16B. Each of the corners of the square orifice is cut on a 45 degree angle to a desired depth of cut 84*a*–84*d* to create four flaps 88*a*–88*d* as shown in FIG. 16C. Next, each of the flaps 88*a*–88*d* are creased lengthwise, to be afterwards positioned as shown FIG. 16D. The hooks-part segments 12*a*–12*d* of a two-part affixing fabric band, known as VELCRO®, are cut to desired measurements (four length as shown), then each of them is coated with fabric glue on the backside, afterwards placed and pressed against the flaps on the backside of the fabric frame 50*d* in a circumferential manner at desired distance away from the geometrically shaped (e.g. square) cut-out orifice 50*c*, afterwards stitched in the said manner along their inner and outer borderlines with stitching 24*g* and 24*h* (FIG. 16E). The VELCRO® bands 12*a*–*d* (affixing means) as shown, when placed and permanently affixed onto the flaps 88*a*–*d* away from the borderlines, will form a internal support structure 10*b* of a similar geometrical shape (e.g. square) to that of the cut-out orifice 50*c*. FIG. 16F shows the resulting assembly from the front side.

Figure 16I:
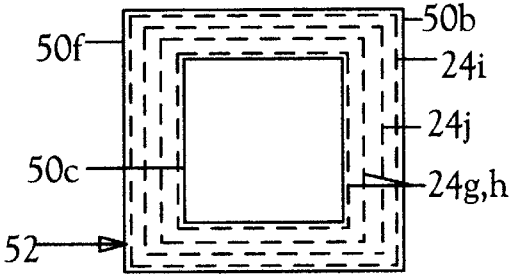
Figure 16J:
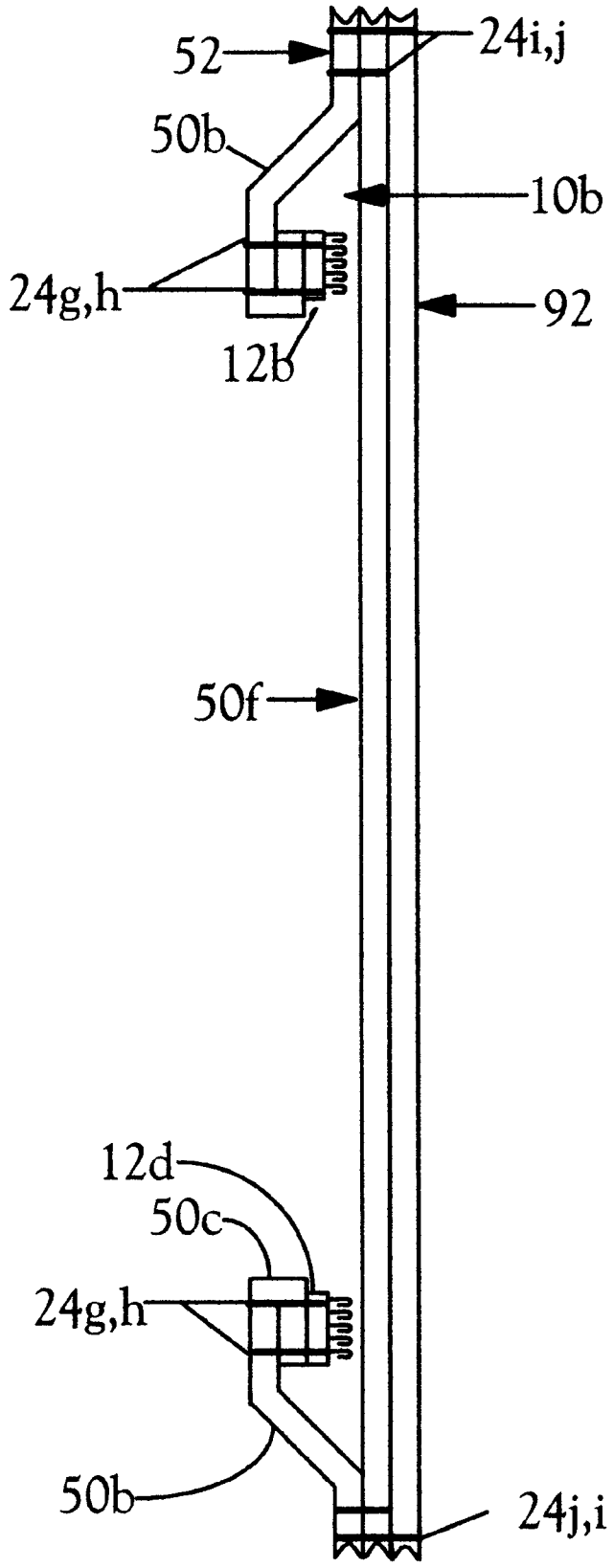

The panel 50*b* with the cut-out orifice 50*c*, onto which the internal support structure 10*b* is permanently affixed, is stitched with a row of stitching 24*i* (FIG. 16I) to a second geometrically shaped (e.g. square) panel 50*f* (FIG. 16H) that has been cut from a second fabric 50*e* (FIG. 16G). The internal support structure 10*b* will then at that time be facing inward to lie against panel 50*f*, and will be hidden from view, after the geometrically shaped (e.g. square) panel 50*f* is stitched to the first panel 50*b* (FIG. 16I). It is preferable to sew another row of stitching 24*j* ¾ to 1½ inches above the borderlines of the geometrical shape (square) cut-out orifice 8*b* in a circumferential manner. This row of stitching 24*j* helps to aid and add strength to the internal support structure 10*b* when an interchangeable and/or reversible underlying section 16 is affixed. When the second panel 50*f* is stitched 24*i* to the first 50*b* with the internal support structure 10*b* permanently affixed onto it, there is formed what I have named a "single-framing container" 52. The single-framing container 52 when finished can be permanently affixed on the surface of the articles made of fabric materials by way of either stitching it along the borderlines, or by some other permanently affixing process. As seen in the cross-sectional view FIG. 16J, the single framing container 52, is permanently affixed onto any suitable location of a fabric of an article made of fabric materials 92. After the single framing container 52 is permanently affixed onto the fabric of an article made of fabric base-material 92, an interchangeable and/or reversible underlying section 16*c* (not shown) is inserted within the geometrically shaped orifice 50*c*, fitting between the fabrics 50*f* and 50*b* afterwards, and affixed onto the internal support structure 10*b*, to thereafter be viewed in the orifice 50*b* when one views the orifice 50*b* from the outside.

Figure 17A:
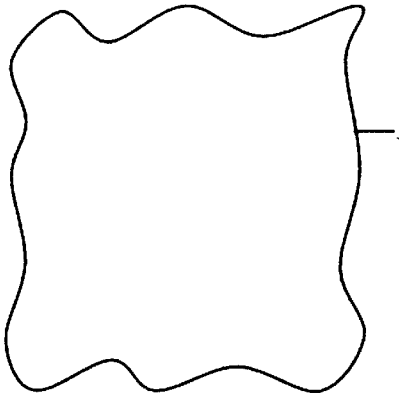
FIGS. 17A–17E show yet an another alternative method of designing and constructing the present invention, more specifically the internal support structure.
Figure 17B:
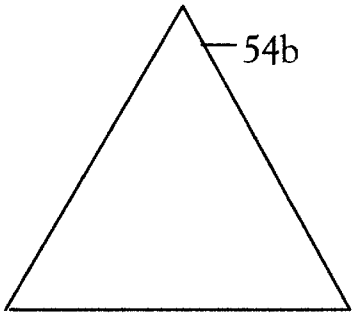
Figure 17C:
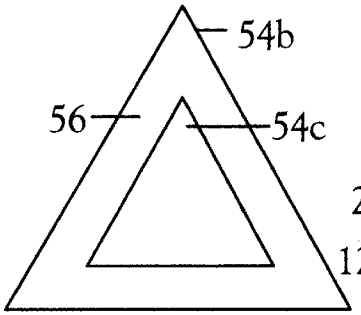
Figure 17D:
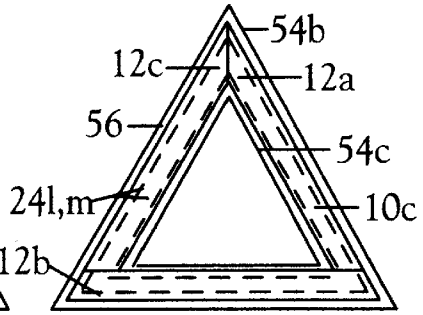

FIGS. 17A–17E demonstrate another alternative method of designing and constructing the present invention, more specifically by providing the internal support structure. A geometrically shaped (e.g. trianglar) cut-out 54*b* (FIG. 17B) is made in a desired fabric 54*a* (FIG. 17A). Then, as shown in FIG. 17C, a geometrically shaped (e.g. trianglar) cut-out orifice 54*c* of desired measurement is also circumferentially made to form a fabric frame 56 within the center of the cut-out triangle 54*b*. The hooks-part segments 12*a*–12*c* of a two-part affixing fabric bands known as VELCRO® are cut to desired measurements (three as shown), then each of them is coated with fabric glue on the backside, afterwards, placed and pressed against the reverse surface of the fabric 54*b* as shown in FIG. 17D in a geometrically shaped (triangular) manner to desired distance e.g. ½ inch, away from the geometrically shaped (e.g. triangle) orifice 54*c* borderlines, then sewn with two lines of stitching 24*l*–24*m* in the said manner as for the other embodiments along the borderlines. The VELCRO® bands 12*a*–12*c* (affixing means as shown), when placed and permanently affixed onto the surface of the fabric 54*b* away from the borderlines of the fabric frame 56, will form an internal support structure 10*c* of a similar geometrical shape (triangular) to that of the cut-out orifice 54*c*.

Figure 17E:
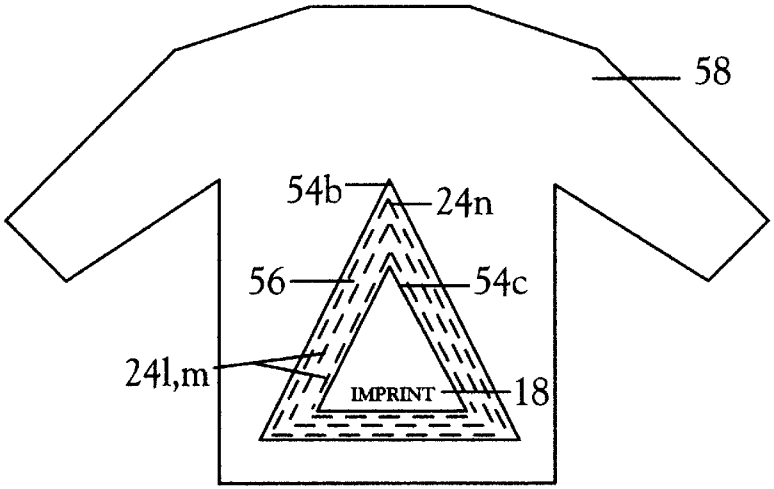

The fabric 54*b* carrying the internal support structure 10*c* at this point can be placed onto a suitable location of a desired article made of fabric base-material 58 (as shown in FIG. 17E), afterwards, permanently affixed onto the article with stitching 24*n*. The reverse side of fabric 54*b* and the segments 12*a*–12*c* face fabric material 58. As in the other embodiments, an underlying section 16 bearing imprints 18 or pockets or pouches 20 can lastly be connected beneath the edges of the orifice.

Figures 18A, 18B, 18C, 18D, 18E, 18F, 18G, 18H:
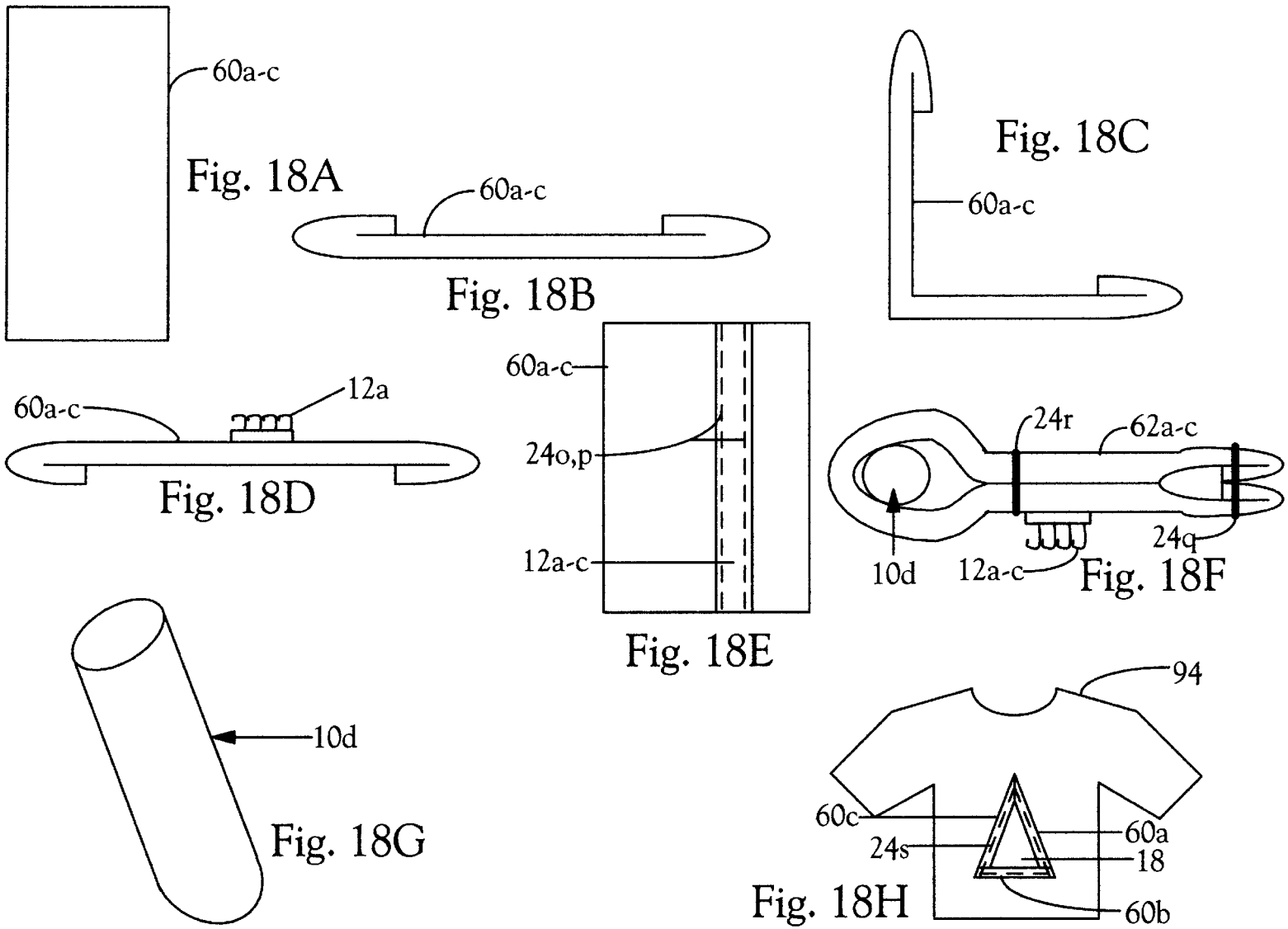
FIGS. 18A–18H show yet an another alternative method of designing and constructing the present invention, more specifically the internal support structure.
Figures 19A, 19B, 19C, 19D, 19E, 19F, 19G, 19H, 19I, 19J:
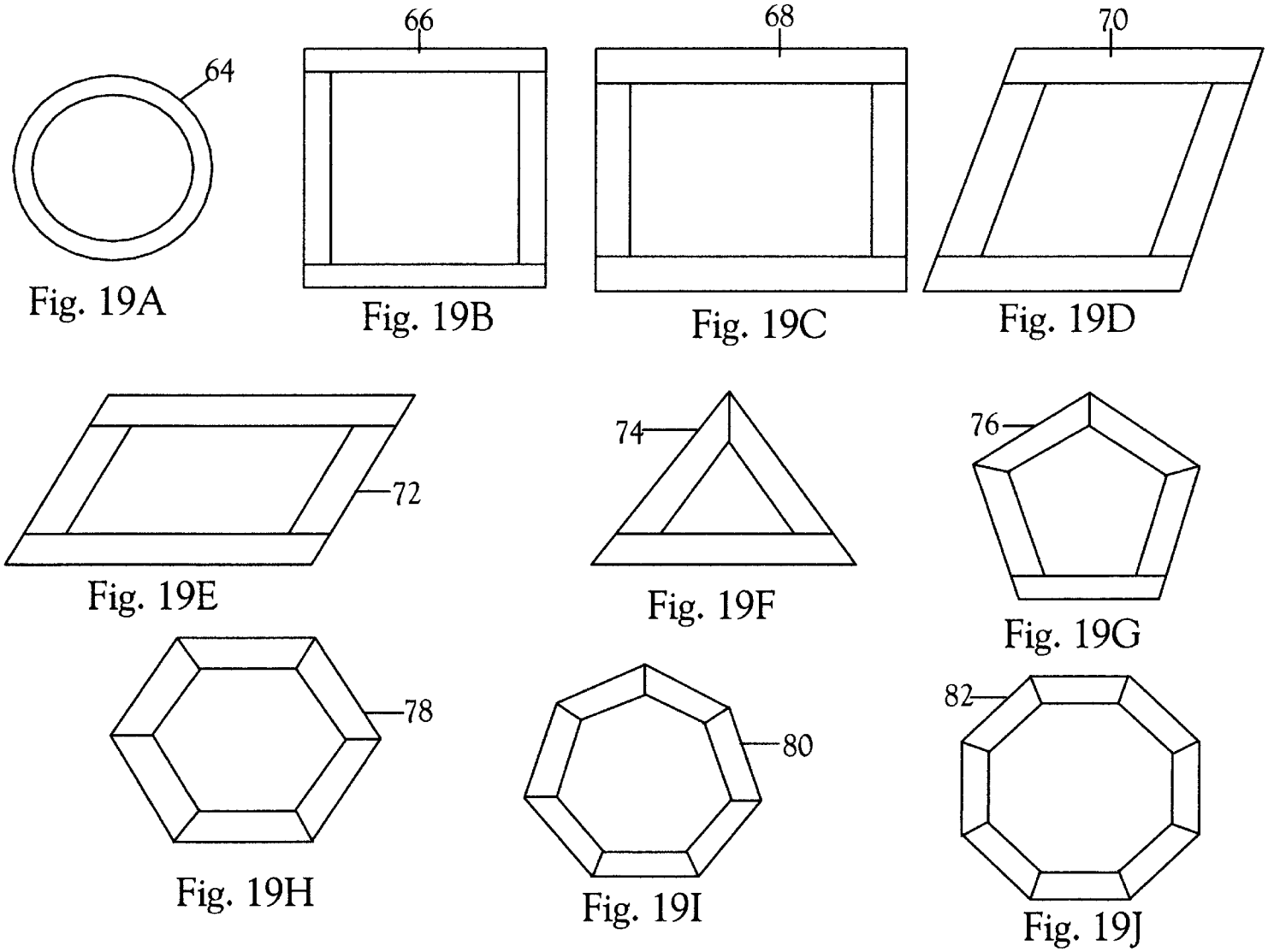
FIGS. 19A–19J illustrate various geometrical shapes of the interchangeable and/or reversible underlying sections, and also that of the articles made of fabric materials which are indicated by their numbers.

FIGS. 18A–18H shows yet another alternative method of designing and constructing the present invention, more specifically by providing an internal support structure 10*d*. Three strips of fabric 60*a*–60*c* (FIG. 18E) are cut to desired length and width (FIG. 18A). Fold and iron each of the raw edges length wise upward and inward (as shown in FIG. 18B), then fold each of them at the center (FIG. 18C). The hooks-part 12*a*–12*c* of a two-part affixing fabric bands of hooks 12*a*–12*c* and loops 14*a*–14*c*, known as VELCRO®, are cut a little shorter than the fabric strips 60*a*–60*c*, then coated with fabric glue on their backsides, following which, they are placed and pressed on the reverse surface side of fabric strips 60*a*–60*c* length wise ½ inch away from the fold at the center as shown in FIG. 18D, then stitching 24*o*–24*p* is sewn on the inner and outer edges in a circumferential manner. Then, add one row of stitching 24*q* along the folded edges, as shown in FIG. 18F. Three pieces of tubing 62*a*–62*c* (FIG. 18G) are then cut a little shorter than the three strips of fabric 60*a*–60*c*. Each of the tubings 62*a*–62*c* is then inserted within each of the fabric strips 60*a*–60*c*, being centered and positioned at the fold lengthwise, and afterwards held in place with a row of stitching 24*r* (FIG. 18F). Next, the three finished fabric strips 60*a*–60*c*, carrying the hooks-part 12*a*–12*c* of the two-part fabric bands commonly called VELCRO ® bands on their underside, are placed and permanently affixed in a geometrically shaped (trianglar) manner onto a suitable location of the surface of an article made of fabric base-material 94 (as shown in FIG. 18H) by way of stitching 24*s* or some other permanently affixing process.

It is very important to note that the alternative designs and constructions of the present invention, more particularly the internal support structure, have a common concept with the first design and construction which was illustrated earlier above with reference to FIG. 2. The interchangeable and/or reversible underlying section is still inserted within the geometrically shaped orifice, fitting between the fabrics afterwards, and affixed onto the internal support structure, to thereafter be viewed in the orifice when one views the orifice from the outside.

FIGS. 19A–19J illustrate the various geometrical shapes that the interchangeable and/or reversible underlying sections 16 can have, in order to match correspondingly shaped orifice frames on articles made of fabric materials. There are: a circular shape 64 in FIG. 19A, a square shape 66 in FIG. 19B, a rectangle 68 in FIG. 19C, a rhombus 70 in FIG. 19D, a rhomboid 72 in FIG. 19E, a triangle 74 in FIG. 19F, a pentagon 76 in FIG. 19G, a hexagon 78 in FIG. 19H, a heptagon 80 in FIG. 19I and a octagon 82 in FIG. 19J. In each illustration, the loops part of the affixing system is shown in place on the perimeter of the shape. However, hooks-part can likewise be placed on the perimeter of the shape, and the loops-part can be placed on the shape of the orifice's internal support structure on the articles made of fabric materials.

While this present invention has been depicted in relationship with preferred embodiments thereof, it is evident that alterations, modifications and productions therein may be made by those in the art to which it pertains without departing from the spirit and scope of the present invention. Additionally, any type of fastening means could be implemented to affix the underlying sections to the article made of fabric materials, for instance fastening means such as snaps, mild adhesives, and the like. Also, instead of folding and sewing the raw edges of the orifices, and the interchangeable and/or reversible underlying section by way of stitching, a serging machine can be employed to serge them. The edges can also made to be hidden by sewing fabric bands around them. These applications can cause the orifice and underlying section to look neater, or varied, appearance wise. Accordingly, the scope of this present invention is to be limited only by the appended claims and any equivalents allowed by the law of patents.

What is claimed is:

1. An article comprising a fabric material having an outside surface, an inside surface, and an orifice, an affixing means on the inside surface bordering the orifice and hidden from view when one views the orifice and the outside surface, the affixing means being one part of a multi-part affixing means comprised of said one part and an other part, said one part being distributed on the inside surface bordering the orifice so as to obtain essentially complete closure when joined with a similarly distributed other part on the border of an underlying section, the affixing means providing interchangeable or reversible attachment of an underlying section, and a panel or base-material (2*b*, 50*f*, 58, 94) permanently secured to the inside surface of the material around the orifice, outwards of the affixing means and extending across the orifice.

2. An article as claimed in claim 1, further comprising an underlying section affixed to the affixing means and visible in the orifice when one views the orifice and the outside surface.

3. An article as claimed in claim 2, the underlying section having an imprint, pocket or pouch on one side thereof, and an affixing means on a border region of said one side, outwards of the imprint, pocket or pouch, the imprint, pocket or pouch being visible in the orifice when one views the orifice and the outside surface.

4. An article as claimed in claim 3, the section further having an imprint, pocket or pouch on a reverse side thereof, and an affixing means on a border region of said reverse side, outwards of the imprint, pocket or pouch on the reverse side.

5. An article as claimed in claim 1, the orifice extending through the material between the outside surface and the inside surface.

6. An article as claimed in claim 5, wherein the panel or base-material is a panel (2*b*).

7. An article as claimed in claim 5, the orifice comprising a cut-out orifice in the material.

8. An article as claimed in claim 5, the material comprising a frame (5O*d*,56).

9. An article as claimed in claim 8, wherein the panel or base-material is a panel (50*f*), whereby a single-framing container (52) is formed.

10. An article as claimed in claim 9, further comprising a base-material (92), the single-framing container being permanently secured to the base-material (92) outwards of the affixing means.

11. An article as claimed in claim 8, wherein the panel or base-material is a base-material (58), the frame (56) being permanently secured to the base-material outwards of the affixing means.

12. An article as claimed in claim 5, the material comprising a plurality of assembled strips (60*a*–60*c*).

13. An article as claimed in claim 12, wherein the panel or base-material is a base-material (94), the assembled strips being permanently secured to the base-material outwards of the affixing means.

14. An underlying section having an imprint, pocket or pouch on one side thereof, and affixing means on a border region of said one side, outwards of the imprint, pocket or pouch, the affixing means on said one side being an other part of a multi-part affixing means comprised of a one part and said other part, said other part being distributed on the border region so as to obtain essentially complete closure when joined with a similarly distributed one part on an inside surface bordering an orifice of a material, the affixing means providing interchangeable or reversible attachment at such an orifice, farther having an imprint, pocket or pouch on a reverse side thereof, and an affixing means of the same characteristics on a border region of said reverse side, outwards of the imprint, pocket or pouch on the reverse side.

15. A method of using an underlying section having an imprint, pocket or pouch on one side thereof, and an affixing means on a border region of said one side, outwards of the imprint, pocket or pouch, said method comprising inserting the underlying section through the orifice of an article comprising a fabric material having an outside surface, an inside surface, and an orifice, and an affixing means on the inside surface bordering the orifice and hidden from view when one views the orifice and the outside surface, aligning the affixing means of the underlying section with that of the article, and joining the two affixing means together, so that the imprint, pocket or pouch is displayed in the orifice when viewing the outside surface of the material.

16. A method as claimed in claim 15, the affixing means permitting interchanging or reversing of the underlying section.

17. A method as claimed in claim 16, further comprising interchanging the underlying section.

18. A method as claimed in claim 16, further comprising reversing the underlying section.

19. A method as claimed in claim 16, the article further comprising a panel or base-material (2*b*, 50*f*, 58, 94) permanently secured to the inside surface of the material around the orifice, outwards of the affixing means and extending across the orifice.

20. An article comprising a fabric material having an outside surface, an inside surface, and an orifice extending through the material between the outside surface and the inside surface, an affixing means on the inside surface bordering the orifice, the affixing means being one part of a multi-part affixing means comprised of said one part and an other part, said one part being distributed on the inside surface bordering the orifice so as to obtain essentially complete closure when joined with a similarly distributed other part on the border of an underlying section, the affixing means providing interchangeable or reversible attachment of an underlying section, and a panel or base-material (2*b*, 50*f*, 58, 94) permanently secured to the inside surface of the material around the orifice, outwards of the affixing means and extending across the orifice.

* * * * *